United States Patent [19]

Bedford

[11] Patent Number: 4,686,724

[45] Date of Patent: Aug. 18, 1987

[54] SUPPORT PAD FOR NONAMBULATORY PERSONS

[76] Inventor: Peter H. Bedford, 21582 Kanakoa La., Huntington Beach, Calif. 92646

[21] Appl. No.: 828,286

[22] Filed: Feb. 11, 1986

Related U.S. Application Data

[63] Continuation-in-part of Ser. No. 752,451, Jul. 5, 1985, abandoned, which is a continuation of Ser. No. 584,458, Feb. 28, 1984, abandoned, which is a continuation-in-part of Ser. No. 487,582, Apr. 22, 1983, abandoned.

[51] Int. Cl.[4] ..... A47C 27/14; A61G 7/00

[52] U.S. Cl. ..... 5/468; 5/481

[58] Field of Search ..... 5/468, 462, 464, 481, 5/448, 431, 465, 469

[56] References Cited

U.S. PATENT DOCUMENTS

| | | | |
|---|---|---|---|
| 1,517,617 | 12/1924 | Cleveland | 5/468 |
| 2,659,418 | 11/1953 | Berman | 5/462 |
| 2,785,739 | 3/1957 | McGregor et al. | 5/481 |
| 3,258,791 | 7/1966 | Kaplan | 5/481 |
| 3,381,999 | 5/1968 | Steere | 5/468 |
| 3,451,071 | 6/1969 | Whiteley | 5/465 |
| 3,885,257 | 5/1975 | Rogers | 5/481 |
| 3,974,532 | 8/1976 | Ecchuya | 5/448 |
| 4,070,719 | 1/1978 | Morgan | 5/468 |
| 4,603,445 | 8/1986 | Spann | 5/468 |
| 4,620,337 | 11/1986 | Williams et al. | 5/481 |

FOREIGN PATENT DOCUMENTS

| | | | |
|---|---|---|---|
| 1310373 | 3/1973 | United Kingdom | 5/468 |
| 2025234 | 11/1980 | United Kingdom | 5/448 |

OTHER PUBLICATIONS

"Body Care" A Trade Brochure by SSI International, Inc., 1820 Savannah Highway, Charleston, S.C. 29407, 1982 or earlier.

*Primary Examiner*—Alexander Grosz
*Attorney, Agent, or Firm*—Price, Gess & Ubell

[57] ABSTRACT

An open cell foam pad is ripple-cut to create a convoluted face of hills and valleys. A plurality of air-flow channels are cut through the pad in each valley formed. The channels with plugs therein provide the user of the pad with the ability to direct air circulation through the pad to certain parts of the body. These air channels also function to dissipate excess body fluids or medicines. For situations demanding the highest possible amount of air circulation, the ripple-cut pad with open air-flow channels is flat-topped. The size of the flat area on each hill is determined by the weight of body to be supported. For a body weight under 100 pounds, a maximum area of ½ inch by ½ inch is used with a contact surface to open space ratio of 1:3. For a body weight between 100 and 150 pounds, a maximum area of 1 inch by 1 inch is used with a contact surface to open space ratio of 1:1. For a body weight greater than 150 pounds, a maximum of area of 1¼ inch by 1¼ inch is used.

4 Claims, 7 Drawing Figures

SUPPORT PAD FOR NONAMBULATORY PERSONS

CROSS-REFERENCE TO RELATED APPLICATIONS

This application is a continuation-in-part of application Ser. No. 752,451, filed July 5, 1985 now abandoned, which is a continuation of application Ser. No. 584,458, filed Feb. 28, 1984, now abandoned, which is a continuation-in-part of application Ser. No. 487,582, filed Apr. 22, 1983, now abandoned.

BACKGROUND OF THE INVENTION

1. Field of the Invention

The present invention relates to specialty pads or cushions, and more particularly pertains to padding used by nonambulatory persons to soften the impact or contact between parts of their body and a reclining surface.

2. Description of the Prior Art

Those concerned with manufacturing and selling pads to be used by nonambulatory persons as bed pads or chair pads, for example, have been aware of the need for providing for ample air circulation around the injured or immobile area of the body. Actually, an injured area of the body requires more air circulation than a healthy part which is simply immobile. Pads used for this purpose prior to the present invention have made little if no distinction between this difference in airflow demand for injured versus noninjured parts of the body.

SUMMARY OF THE INVENTION

According to the present invention, the shortcomings and failure of the prior art are overcome by an open cell foam pad that may be ripple cut so as to be convoluted on one face forming a series of protruberances and valleys therebetween, is then press cut to form a plurality of appropriately sized channels from one face to the other in the valleys. The plugs formed as a result may remain in the channels, but are readily and selectively removable to provide for increased airflow or circulation in selected parts of the pad. These channels also perform the additional function of quickly dissipation run-off of body fluids and medicinal liquids. For nonambulatory situations demanding as much air circulation as possible, the invention provides a flat-top open-cell convoluted foam pad with channels in the valleys therethrough wherein each independent flat-top area is no larger than $1\frac{1}{4}$ inches in diameter.

BRIEF DESCRIPTION OF THE DRAWINGS

Many of the attendant advantages of this invention will be readily appreciated as the invention becomes better understood by reference to the following detailed description when considered in conjunction with the accompanying drawings in which like reference numerals designate like parts throughout the figures thereof and wherein.

DESCRIPTION OF THE PREFERRED EMBODIMENT

Figure 1:
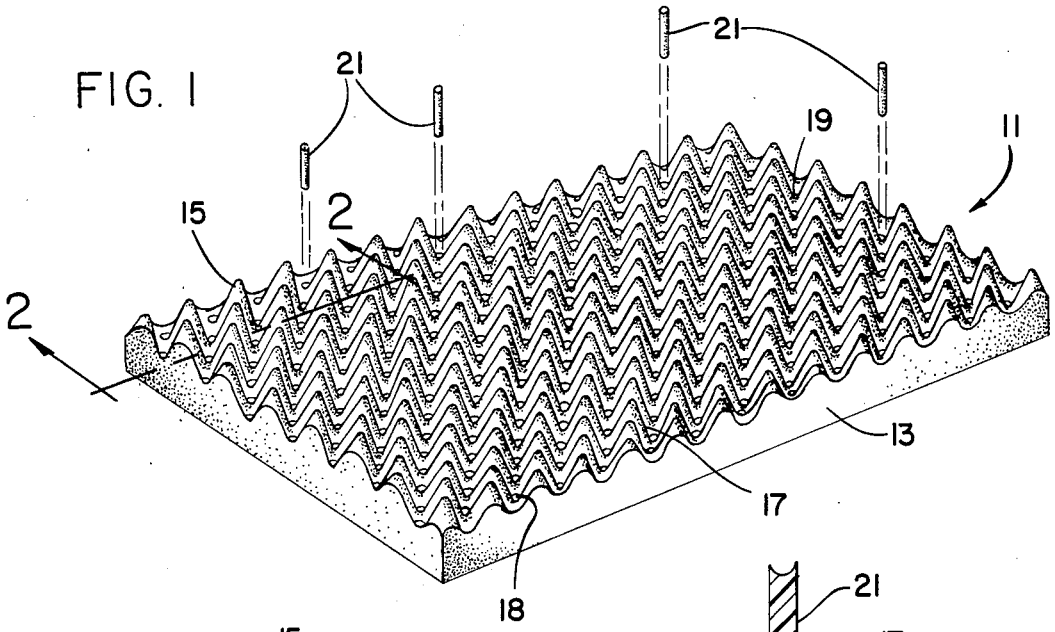
FIG. 1 is a perspective view, partially exploded, of a pad according to a preferred embodiment of the invention.
Figure 2:
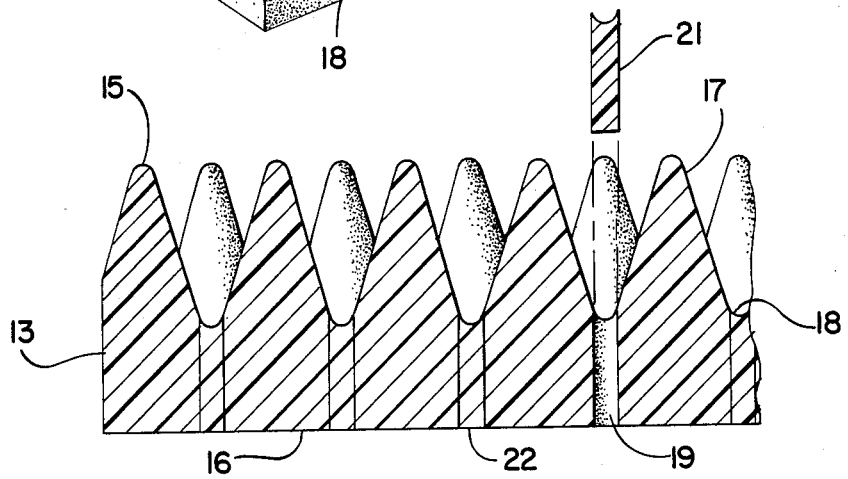
FIG. 2 shows a section of the preferred embodiment shown in FIG. 1 taken along line 2—2 of FIG. 1 looking in the direction of the arrows.
Figure 3:
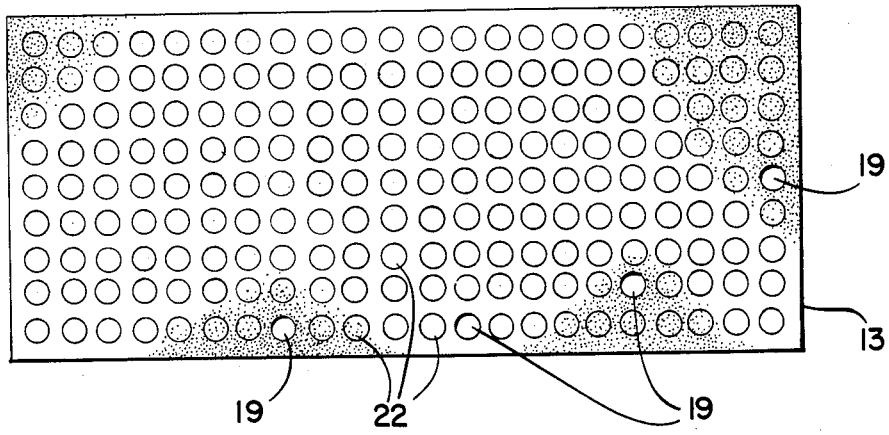
FIG. 3 is a plan view of the bottom of the pad shown in FIG. 1.

FIG. 1, which illustrates a preferred embodiment of the nonambulatory pad, shows a perspective view of a pad 11 having a body 13 composed of a foam material such as open cell foam or the like. FIG. 1 shows face 15 ripple cut to create convoluted surface composed of hills 17 and valleys 18 over the entire face. The opposite face 16, on the other hand, is flat.

Although this is a preferred embodiment of the present invention, a foam pad that is wedged can utilize the present invention with equal advantage. In other words, face 15 that is convoluted, would, for example, be cut at an angle to bottom face 16 to provide an inclined rest surface. Or, face 15 could be parallel to face 16, thereby providing a flat pad.

A plurality of air channels 19 are stamped, press cut or laser cut into the foam pad body 13, leaving the plugs 22 formed thereby located in the newly-formed channels. Removing the individual plugs 21 from certain areas of the pad body 13 causes air channels 19 to be created in that area. Only the plugs 22 that remain in the pad body 13 function to effectively block air passage in the respective channel.

The air trapped in the air channels without plugs 21 functions to aerate the skin of the nonambulatory person resting on the pad, and specifically that part of his body resting on the pad having open channels. Besides trapping air, these channels provide for increased aeration of body parts overlying them. The channels cause a reduction in body heat, as well as dissipating excess body fluids and liquids such as medicines through the pad, away from the skin surface. These advantages are of great utility to nonambulatory persons such as burn victims or persons with other skin disorders.

In nonambulatory situations, it is imperative that as much air as possible reach all parts of the body in repose on the pad, including those parts that are in contact with the pad. In such a case, it is not enough to simply have an undulating surface pad with air-flow channels therethrough. The hills 17 of the ripple cut surface tend to fold into the valleys and obstruct the air channels 19 in the pad. In addition, the relative size of the hills and valleys, and the air channels, must be optimized to not only provide as much air circulation as possible but to reduce pressure on all areas of the body, thereby preventing decubitus ulcers.

Figure 4:
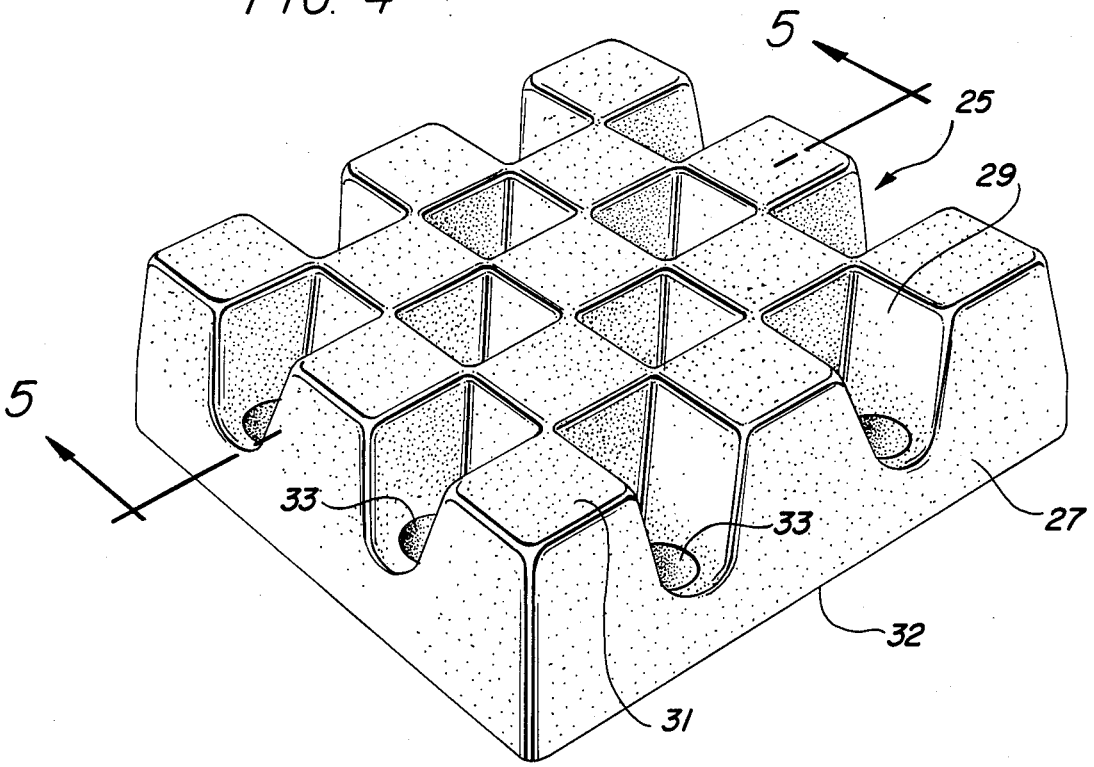
FIG. 4 is a perspective view of an alternate preferred embodiment of a pad according to the present invention.
Figure 5:
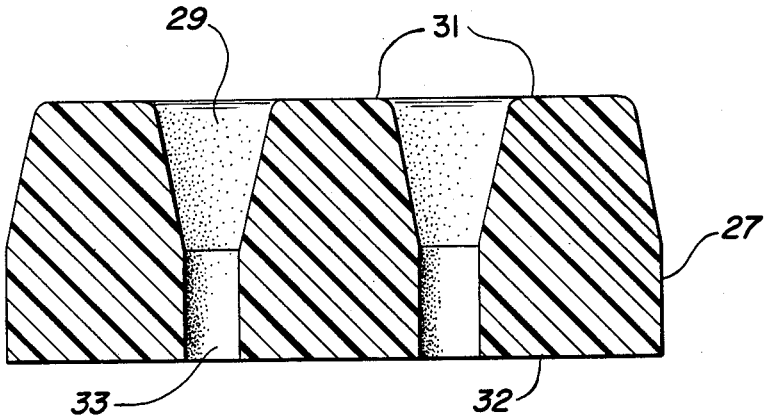
FIG. 5 is a sectional view of the embodiment shown in FIG. 4 taken along like 5—5 of FIG. 4 looking in the direction of the arrows.

The preferred embodiment shown in FIGS. 4 and 5 provides a support pad with passive thermocline airflow near the body parts contacting the pad at a volume that has been thought impossible until the present invention.

The nonambulatory support pad 25 shown in FIG. 4 has a body 27, a convoluted surface 31 and a flat surface 32. The hills of the convoluted side 31 have been topped to create a broken flat surface 31, interposed with valleys 29, each valley having a channel 33 therethrough from the valley floor to the opposite flat face.

Figure 6:
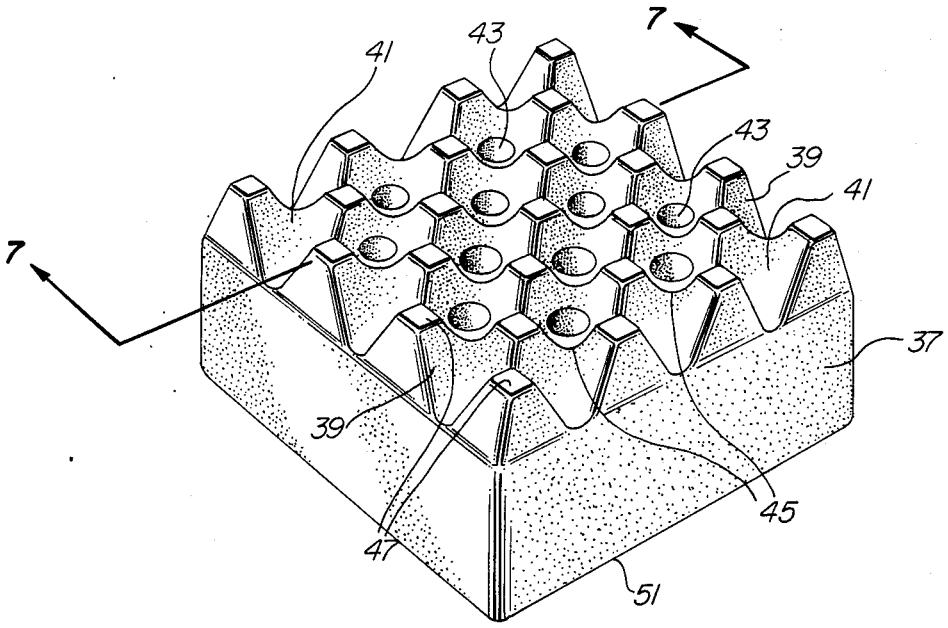
FIG. 6 is a perspective view of an alternate preferred embodiment of a pad according to the present invention.
Figure 7:
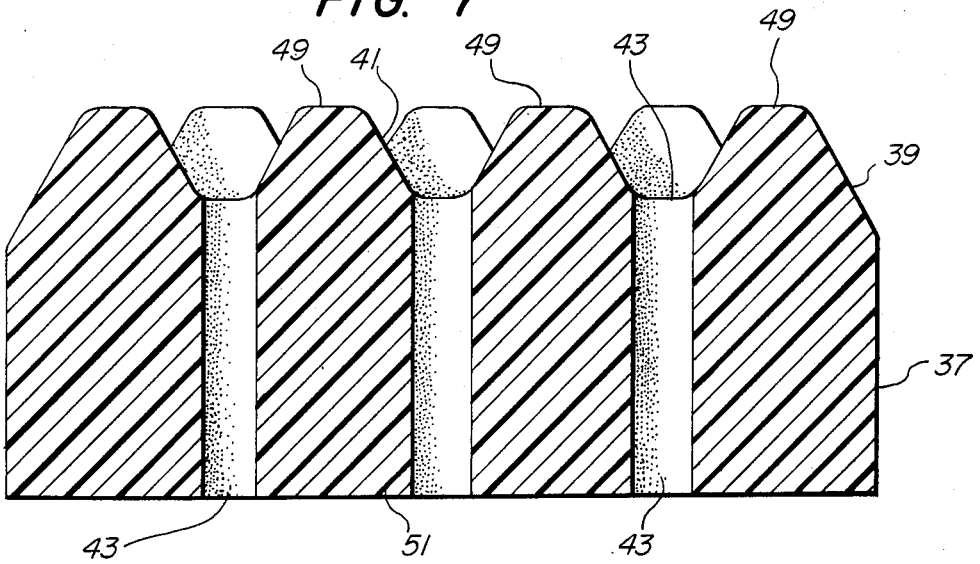
FIG. 7 is a sectional view of the embodiment shown in FIG. 6 taken along like 7—7 of FIG. 6 looking in the direction of the arrows.

In an improved version shown in FIGS. 6 and 7, in order to reduce the pressure exerted by each individual flat top area 31, the flat tops are raised above the common plane 45 to a higher contact plane 47. This leaves each flat top area independant from the other flat top surface 49, providing for individual movement.

The pad shown in FIGS. 6 and 7 is arranged to provide the least amount of pressure to any one part of the body while providing for maximum air circulation to those areas of the body contacting the surfaces of the pad. The area of each valley 41 at the contact plane 47 is about $1\frac{1}{2}$ inches by $1\frac{1}{2}$ inches, the depth of the valley from the contact surface 47 to the air channels 43 is about 1 inch. Each flat top area 49 on each hill 39 is $\frac{1}{2}$ inch by $\frac{1}{2}$ inch. The overall height of the pad from the flat top plane 47 to the other major side 51 is about $3\frac{1}{4}$ inches. The airflow channels 43 throughout the pad are at least $\frac{5}{8}$ inch in diameter.

This arrangement of hills and valleys supports a 100 pound body evenly throughout the contact area with maximum air flow to the contact area. No closure of the air channels occurs due to folding of the hills into the valleys. The ratio of contact surface area to open area at contact is about 1:3. This provides for a very soft, highly aerated pad that virtually eliminates decubitus ulcers.

For bodies that are heavier, the individual flat-top hills 49 must be made larger in area. For a body between 100 and 150 pounds, a 1 inch by 1 inch flat top area 49 is preferred. In this instance, the contact surface area to open area at contact is on a 1:1 ratio. For bodies heavier than 150 pounds, the individual flat-top hills 49 may be made a little larger. But in no event shall they exceed a diameter larger than $1\frac{1}{4}$ inches. This is the upper size limit of contact surface for the individual flat-top hills 49.

It has been discovered that a skin area of $1\frac{1}{4}$ inches in diameter, even though denied air circulation, can sustain itself from air circulating in an adjacent area, whereas larger areas can not. By limiting the individual flat-top contact surfaces to this size or smaller, the user of the pad is assured of obtaining sufficient oxygen to all parts of his body surface. This virtually eliminates the occurrence of decubitus ulcers, even for the most immobile patients.

By removing the tops of the hills of the convoluted surface leaving the broken flats and valleys, the air channels remain unobstructed even when supporting the weight of a body portion resting on it. A pad that provides both soft, cushioned support and maximum aeration of the body part resting on it is the result.

In order to reduce as much as possible the pressure exerted on any one spot on a body in repose on such a pad, the flat top hills and valleys are arranged to be evenly distributed throughout the support surface of the pad. The relative size of each of the flat surfaces with respect to the voids created by the valleys, is such that each valley at the contact surface is at least equal, and preferably larger than the area of each flat top.

What is claimed is:

1. A pad for nonambulatory persons, said pad having a foam body with a first and second major side for supporting a human anatomy, the improvement in the pad comprising:

a thickness, as measured by the distance between the first and second major side, being about $3\frac{1}{4}$ inches;

a substantially uniform distribution of hills of substantially uniform height and cross-section on the first major side of said foam body, said hills being separated by valleys of a substantially uniform 1 inch depth and a uniform cross-section, each of said hills having a flat top, each of the flat tops on each of said hills being at least $\frac{1}{2}$ inches in diameter and being no larger than $1\frac{1}{4}$ inches in diameter, each of said valleys having an airflow channel terminating at the valley floor and extending through the foam body to the second major side, a plurality of plugs, in a plurality of airflow channels in a manner that permits ready and selective removal of each plug;

the second major side being flat;

whereby the tops of the hills support a human anatomy with even weight distribution and reduced pressure contact in addition to maximizing air circulation to the parts of the human anatomy in contact with the pad.

2. The improved pad of claim 1 wherein said plurality of plugs, one located in each of the airflow channels in a manner that permits ready and selective removal of each plug, is at least $\frac{5}{8}$ inches in diameter.

3. The improved pad of claim 1 wherein the flat tops on each of said hills are no larger than $\frac{1}{2}$ inch by $\frac{1}{2}$ inch, with the ratio of contact surface area to the absence of contact surface area being about 1:3.

4. The improved pad of claim 1 wherein the flat tops on each of said hills are no larger than 1 inch by 1 inch, with the ratio of contact surface area to the absence of contact surface area being about 1:1.

* * * * *